US011538624B2

(12) United States Patent
Yang et al.

(10) Patent No.: US 11,538,624 B2
(45) Date of Patent: Dec. 27, 2022

(54) WIRE WOUND INDUCTOR AND MANUFACTURING METHOD THEREOF

(71) Applicant: SAMSUNG ELECTRO-MECHANICS CO., LTD., Suwon-Si (KR)

(72) Inventors: Ju Hwan Yang, Suwon-Si (KR); Young Seuck Yoo, Suwon-Si (KR); Hwi Dae Kim, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 789 days.

(21) Appl. No.: 16/004,104

(22) Filed: Jun. 8, 2018

(65) Prior Publication Data

US 2019/0198235 A1 Jun. 27, 2019

(30) Foreign Application Priority Data

Dec. 26, 2017 (KR) ..... 10-2017-0180143

(51) Int. Cl.
*H01F 27/29* (2006.01)
*H01F 27/32* (2006.01)
(Continued)

(52) U.S. Cl.
CPC ..... *H01F 27/324* (2013.01); *H01F 17/04* (2013.01); *H01F 27/255* (2013.01);
(Continued)

(58) Field of Classification Search
CPC ..... H01F 27/32; H01F 27/324; H01F 27/29
(Continued)

(56) References Cited

U.S. PATENT DOCUMENTS 7,012,784 B2 * 3/2006 Sasaki ..... G11B 5/313 360/125.47
8,174,349 B2 * 5/2012 Yoshida ..... H01G 4/224 336/200

(Continued)

FOREIGN PATENT DOCUMENTS

CN 104900374 A 9/2015
CN 105448465 A 3/2016

(Continued)

OTHER PUBLICATIONS

Office Action issued in corresponding Chinese Patent Application No. 201811097372.5 dated Jul. 16, 2020, with English translation.

(Continued)

*Primary Examiner* — Elvin G Enad
*Assistant Examiner* — Joselito S. Baisa
(74) *Attorney, Agent, or Firm* — Morgan, Lewis & Bockius LLP

(57) ABSTRACT

There are provided a wire wound inductor and a manufacturing method thereof according to an exemplary embodiment in the present disclosure. The wire wound inductor according to an exemplary embodiment in the present disclosure includes a winding coil, a magnetic core embedding the winding coil, and an adhesive portion disposed between the magnetic core and the winding coil and enclosing the winding coil.

6 Claims, 5 Drawing Sheets

(51) Int. Cl.

| | |
|---|---|
| ***H01F 27/28*** | (2006.01) |
| ***H01F 41/12*** | (2006.01) |
| ***H01F 27/255*** | (2006.01) |
| ***H01F 17/04*** | (2006.01) |
| *H01F 3/14* | (2006.01) |

(52) U.S. Cl.
CPC ..... *H01F 27/2823* (2013.01); *H01F 41/125* (2013.01); *H01F 3/14* (2013.01); *H01F 27/29* (2013.01); *H01F 2017/048* (2013.01)

(58) Field of Classification Search
USPC ..... 336/192, 200
See application file for complete search history.

(56) References Cited

U.S. PATENT DOCUMENTS

| | | | | |
|---|---|---|---|---|
| 9,142,343 | B2 * | 9/2015 | Ohkubo | H01F 27/255 |
| 9,437,363 | B2 * | 9/2016 | Choi | H01F 27/292 |
| 9,490,656 | B2 * | 11/2016 | Kurz | H01F 27/2847 |
| 9,659,709 | B2 * | 5/2017 | Chang | H01F 27/2804 |
| 10,026,539 | B2 * | 7/2018 | Yang | C23F 1/30 |
| 10,074,473 | B2 * | 9/2018 | Kim | H01F 41/122 |
| 10,211,137 | B2 * | 2/2019 | Chen | H01L 23/49827 |
| 10,529,476 | B2 * | 1/2020 | Park | H01F 5/04 |
| 10,553,346 | B2 * | 2/2020 | Ryu | H01F 41/043 |
| 10,902,991 | B2 * | 1/2021 | Moon | H01F 41/24 |
| 10,916,366 | B2 * | 2/2021 | Lee | H01F 17/04 |
| 2008/0236870 | A1 * | 10/2008 | Kuwajima | H01G 4/248 174/126.2 |
| 2009/0280153 | A1 * | 11/2009 | Hunter | A61N 1/3605 424/423 |
| 2013/0181668 | A1 * | 7/2013 | Tabata | H01F 38/14 320/108 |
| 2014/0159228 | A1 * | 6/2014 | Teh | H01L 23/3114 257/734 |
| 2014/0285305 | A1 * | 9/2014 | Yoo | H01F 27/022 336/200 |
| 2015/0102889 | A1 * | 4/2015 | Choi | H01F 27/292 336/200 |
| 2015/0145635 | A1 * | 5/2015 | Kurz | H04B 5/0037 336/232 |
| 2015/0255206 | A1 | 9/2015 | Han et al. | |
| 2015/0270053 | A1 * | 9/2015 | Cha | C25D 5/02 336/192 |
| 2016/0086721 | A1 * | 3/2016 | Park | H01F 27/2804 336/200 |
| 2016/0155556 | A1 * | 6/2016 | Ohkubo | H01F 27/292 336/83 |
| 2016/0268040 | A1 | 9/2016 | Kim et al. | |
| 2016/0276088 | A1 | 9/2016 | Kwon et al. | |
| 2016/0372259 | A1 * | 12/2016 | Banba | H01F 27/2823 |
| 2017/0032885 | A1 | 2/2017 | Lee et al. | |
| 2017/0178798 | A1 | 6/2017 | Yoon et al. | |
| 2017/0194226 | A1 * | 7/2017 | Chen | H01L 21/563 |
| 2019/0326047 | A1 * | 10/2019 | Yamaguchi | H01F 17/0013 |

FOREIGN PATENT DOCUMENTS

| | | | | |
|---|---|---|---|---|
| CN | 106898479 | A | 6/2017 | |
| JP | 2004-040001 | A | 2/2004 | |
| JP | 2005-347542 | A | 12/2005 | |
| JP | 2015187260 | A * | 10/2015 | C09J 11/04 |
| KR | 10-1153954 | B1 | 6/2012 | |
| KR | 10-2014-0083733 | A | 7/2014 | |
| KR | 10-2016-0051695 | A | 5/2016 | |
| KR | 10-2016-0134633 | A | 11/2016 | |
| KR | 10-2017-0015103 | A | 2/2017 | |
| KR | 10-2017-0090144 | A | 8/2017 | |

OTHER PUBLICATIONS

Second Office Action issued in corresponding Chinese Patent Application No. 201811097372.5 dated Mar. 3, 2021, with English translation.

Office Action issued in corresponding Chinese Patent Application No. 201811097372.5 dated Oct. 25, 2021, with English translation.

Korean Office Action dated Jul. 1, 2022, issued in corresponding Korean Patent Application No. 20217567.5.

Korean Office Action dated Jul. 1, 2022, issued in corresponding Korean Patent Application No. 10-2017-0180143.

* cited by examiner

WIRE WOUND INDUCTOR AND MANUFACTURING METHOD THEREOF

CROSS-REFERENCE TO RELATED APPLICATION(S)

This application claims benefit of priority to Korean Patent Application No. 10-2017-0180143 filed on Dec. 26, 2017 in the Korean Intellectual Property Office, the disclosure of which is incorporated herein by reference in its entirety.

TECHNICAL FIELD

The present disclosure relates to a wire wound inductor and a manufacturing method thereof.

BACKGROUND

An inductor, a basic passive element, serves to supply a stable voltage to various components in a product, or to increase or decrease a level of a voltage.

Currently, various types of inductor have been developed and used. Thereamong, a wire wound inductor has a structure in which a winding coil is embedded in a magnetic core. Here, the winding coil and the magnetic core need to be insulated from each other while having sufficient coupling force therebetween.

SUMMARY

An aspect of the present disclosure may provide a wire wound inductor.

Another aspect of the present disclosure may provide a manufacturing method of a wire wound inductor.

According to an aspect of the present disclosure, a wire wound inductor may include: a winding coil; a magnetic core embedding the winding coil; and an adhesive portion disposed between the magnetic core and the winding coil and enclosing the winding coil.

According to another aspect of the present disclosure, a manufacturing method of a wire wound inductor may include: attaching a tape on a first surface of a frame which has a hole; loading at least one winding coil in the hole of the frame, the at least one winding coil being attached to the tape; coating a first insulating adhesive film on a second surface of the frame opposing the first surface; and removing tape attached on the first surface of the frame.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Exemplary embodiments of the present disclosure will now be described in detail with reference to the accompanying drawings.

Figure 1A:
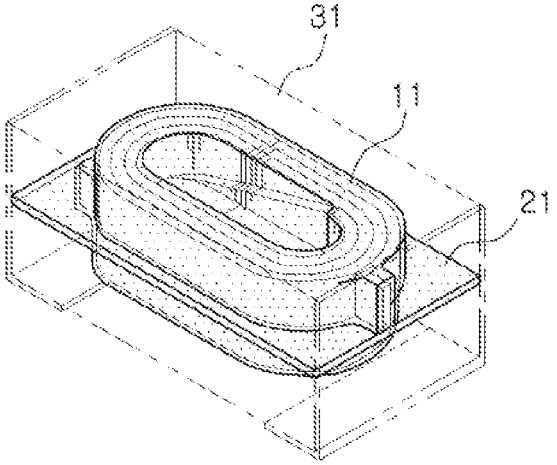
FIGS. 1A through 1C are views schematically illustrating a configuration of a wire wound inductor according to an exemplary embodiment in the present disclosure.
Figure 1B:
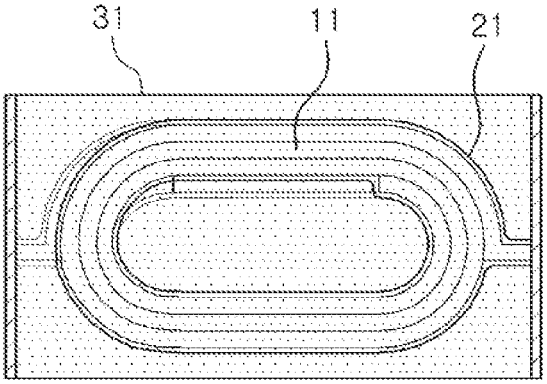
Figure 1C:
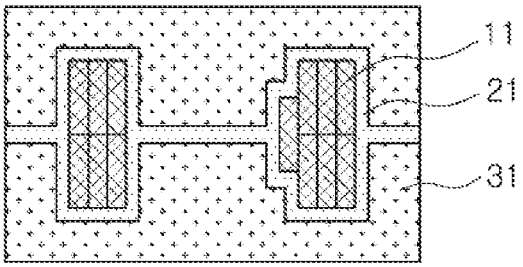

FIGS. 1A through 1C are, respectively, a perspective view, a plan view, and a cross-sectional view schematically illustrating a configuration of a wire wound inductor according to an exemplary embodiment in the present disclosure. A wire wound inductor according to an exemplary embodiment in the present disclosure may include a winding coil 11, an adhesive portion 21, and a magnetic core 31.

The winding coil 11 is a coil formed by winding a conductive wire at least one turn, and may be stacked in two or more layers, if necessary. The winding coil 11 may be a flat wire coil type, and the wire wound inductor according to the exemplary embodiment in the present disclosure may thus be a chip type. However, the types of the winding coil and the wire wound inductor may be variously changed.

The winding coil 11 may be formed of any one or a mixture of at least two of a noble metal material such as silver (Ag), lead (Pb), platinum (Pt), or the like, nickel (Ni), and copper (Cu) which have excellent conductivity. In addition, the winding coil 11 may further include an insulating film coated on a surface of a wire to secure insulation among wires of the winding coil 11.

Further, an end portion of the winding coil 11 may extend toward the outside of the magnetic core 31, and the extended portion may be electrically connected to an external electrode (not illustrated).

The adhesive portion 21 may be implemented by an insulating adhesive film. For example, the adhesive portion 21 may be formed using an Ajinomoto Build-up Film (ABF). Further, the adhesive portion 21 may be formed to enclose the entire winding coil 11. In addition, the adhesive portion 21 may be formed even in a central portion and an outer side portion of the winding coil 11. The adhesive portion 21 formed in the central portion and the outer side portion of the winding coil 11 may be positioned in the vicinity of a center of the winding coil 11 in a thickness direction. Accordingly, the magnetic core 31 may be formed on and beneath the adhesive portion 21 formed in the central portion and the outer side portion of the winding coil 11. The adhesive portion 21 may insulate the winding coil 11 from the magnetic core 31, and at the same time, improve coupling force between the winding coil and the magnetic core 31. Further, in a process of manufacturing the wire wound inductor, the adhesive portion 21 may secure connectivity between the winding coil 11 and a frame, thereby reducing defects caused by misalignment of the winding coil during manufacture of the wire wound inductor. In addition, in the process of manufacturing the wire wound inductor, the adhesive portion 21 may suppress separation of the frame from the winding coil 11 before stacking a sheet and/or during stacking of a sheet, thereby reducing a defect that the frame is separated.

The magnetic core 31 may be formed of a magnetic resin composite in which metal magnetic powder and a resin mixture are mixed. The metal magnetic powder may be formed of at least one of, for example, Fe—Ni, amorphous Fe, Fe, an Fe—Cr—Si alloy, and an Fe—Si—Al alloy, and the resin mixture may be formed of at least one of, for example, an epoxy, polyimide, and a liquid crystal polymer (LCP), but the materials of the metal magnetic powder and the resin mixture are not limited thereto. The magnetic core 31 may function as a space in which a magnetic path is formed, the magnetic path being a path through which a magnetic flux induced in the winding coil 11 when a current is applied to the winding coil 11 passes. The magnetic core 31 may be formed so that the winding coil 11 is embedded therein. At this time, at least a portion of each of both ends of the winding coil 11 may be exposed to the outside of the magnetic core 31 to be connected to an external electrode.

Figure 2A:
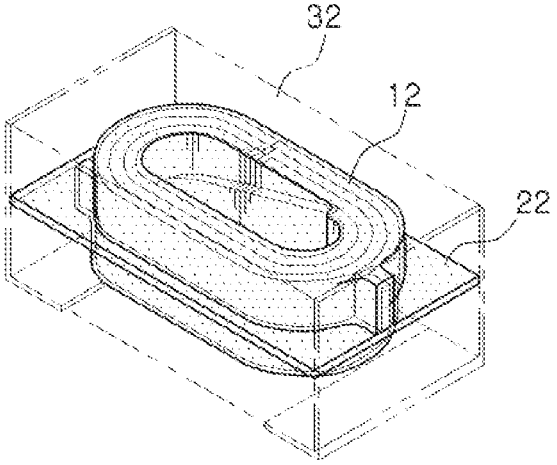
FIGS. 2A through 2C are views schematically illustrating a configuration of a wire wound inductor according to another exemplary embodiment in the present disclosure.
Figure 2B:
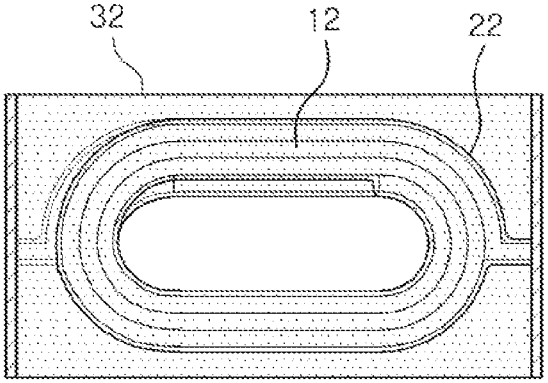
Figure 2C:
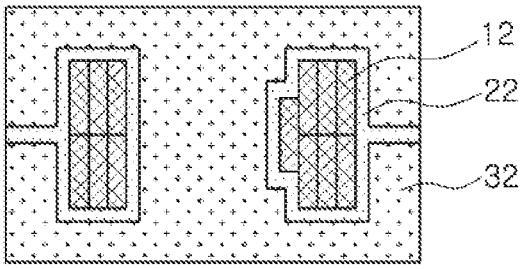

FIGS. 2A through 2C are, respectively, a perspective view, a plan view, and a cross-sectional view schematically illustrating a configuration of a wire wound inductor according to another exemplary embodiment in the present disclosure.

A winding coil 12 and a magnetic core 32 may be the same as the winding coil 11 and the magnetic core 31 described in FIGS. 1A through 1C.

Further, an adhesive portion 22 may be the same as the adhesive portion 21 described in FIGS. 1A through 1C except that the adhesive portion 22 is not formed in a central portion of the winding coil 12, in comparison to the adhesive portion 21 described in FIGS. 1A through 1C.

Figure 3:
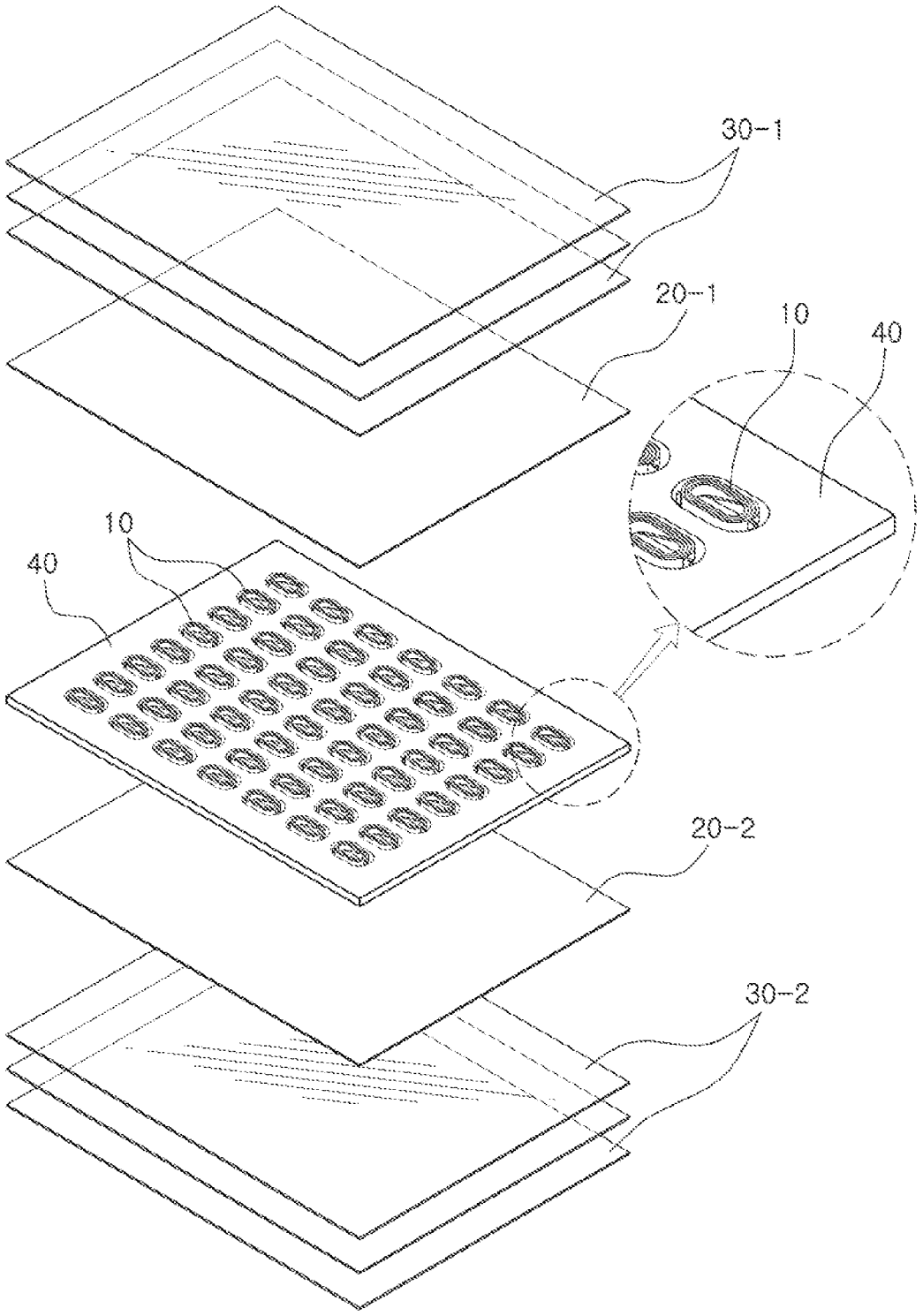
FIG. 3 is a view for explaining a manufacturing method of a wire wound inductor according to an exemplary embodiment in the present disclosure.

FIG. 3 is a view for explaining a manufacturing method of a wire wound inductor according to an exemplary embodiment in the present disclosure.

In the manufacturing method of a wire wound inductor according to an exemplary embodiment in the present disclosure, a plurality of winding coils 10 may be loaded in hollow portions formed in a frame 40.

Then, an insulating adhesive film 20-1 may be positioned and then compressed on one surface of the frame 40 and an insulating adhesive film 20-2 may be positioned and then compressed on the other surface of the frame 40 to form an adhesive portion (21 in FIGS. 1A through 1C or 22 in FIGS. 2A through 2C). The insulating adhesive film 20-1 and the insulating adhesive film 20-2 are films having both of adhesive force and an insulating property, and may be an Ajinomoto Build-up Film (ABF).

In addition, at least one magnetic sheet 30-1 may be positioned and then compressed on one surface of the frame 40 and at least one magnetic sheet 30-2 may be positioned and then compressed on the other surface of the frame 40 to form a magnetic core (31 in FIGS. 1A through 1C or 32 in FIGS. 2A through 2C). An individual structure including a respective magnetic core, a respective winding coil, and respective insulating adhesive films may be separated from the frame 40 and become a wire wound inductor. Accordingly, a plurality of wire wound inductors may be formed when the respective structures are separated from the frame 40.

After the insulating adhesive film 20-1 is compressed and before the insulating adhesive film 20-2 is attached to the winding coils 10 and compressed, a tape, which is attached on the other surface of the frame 40 to allow the winding coils 10 to be disposed in the accommodation spaces provided by the frame 40 and by the tape, may be removed. In this process, a phenomenon that a portion of the frame 40 is separated from the other portion of the frame 40 may occur, when the tape is removed from the frame. However, in accordance with the manufacturing method of a wire wound inductor according to the exemplary embodiment in the present disclosure, the insulating adhesive film 20-1 increasing a coupling force between the winding coils 10 and the frame 40 may prevent the separation phenomenon, when the tape is removed from the frame 40.

Figure 4:
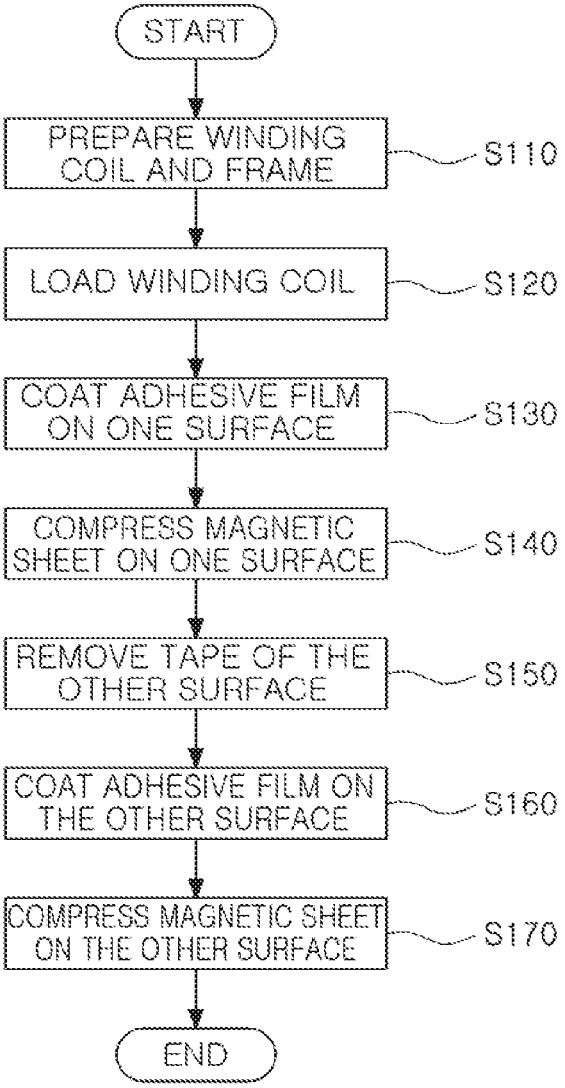
FIG. 4 is a flowchart for explaining a manufacturing method of a wire wound inductor according to an exemplary embodiment in the present disclosure.

FIG. 4 is a flowchart for explaining a manufacturing method of a wire wound inductor according to an exemplary embodiment in the present disclosure.

The manufacturing method of a wire wound inductor according to the exemplary embodiment in the present disclosure will be described below with reference to FIGS. 3 and 4.

First, the winding coils 10 and the frame 40 may be prepared (S110).

Next, each of the winding coils 10 may be loaded in a designated position in the frame 40 (S120).

Next, the insulating adhesive film 20-1 may be coated on one surface (e.g., upper surface) of the frame 40 in which the winding coils 10 are loaded (S130). For example, the insulating adhesive film 20-1 may be positioned and then compressed on one surface of the frame 40.

Next, at least one magnetic sheet 30-1 may be positioned and then compressed on one surface of the frame 40 on which the insulating adhesive film 20-1 is coated (S140). As described above, according to the exemplary embodiment in the present disclosure, connectivity between the winding coils 10 and the frame 40 may be sufficiently secured by the insulating adhesive film, such that misalignment of the coil when compressing the magnetic sheet 30-1 may be prevented. Therefore, according to the exemplary embodiment in the present disclosure, a yield may be improved.

Next, the tape attached on the other surface of the frame 40 may be removed (S150). As described above, according to the exemplary embodiment in the present disclosure, adhesive force between the winding coil 10 and the frame 40 is increased by the insulating adhesive film 20-1, thereby suppressing separation of the frame 40. Therefore, according to the exemplary embodiment in the present disclosure, a yield may be improved.

Next, the insulating adhesive film 20-2 may be coated on the other surface (e.g., lower surface) of the frame 40 in which the winding coils 10 are loaded (S160). For example, the insulating adhesive film 20-2 may be positioned and then compressed on the other surface of the frame 40.

Next, at least one magnetic sheet 30-2 may be positioned and then compressed on the other surface of the frame 40 on which the insulating adhesive film 20-2 is coated (S170). An individual structure including a respective magnetic core, a respective winding coil, and respective insulating adhesive films may be separated from the frame 40 and become a wire wound inductor. Accordingly, a plurality of wire wound inductors may be formed when the respective structures are separated from the frame 40.

Figure 5:
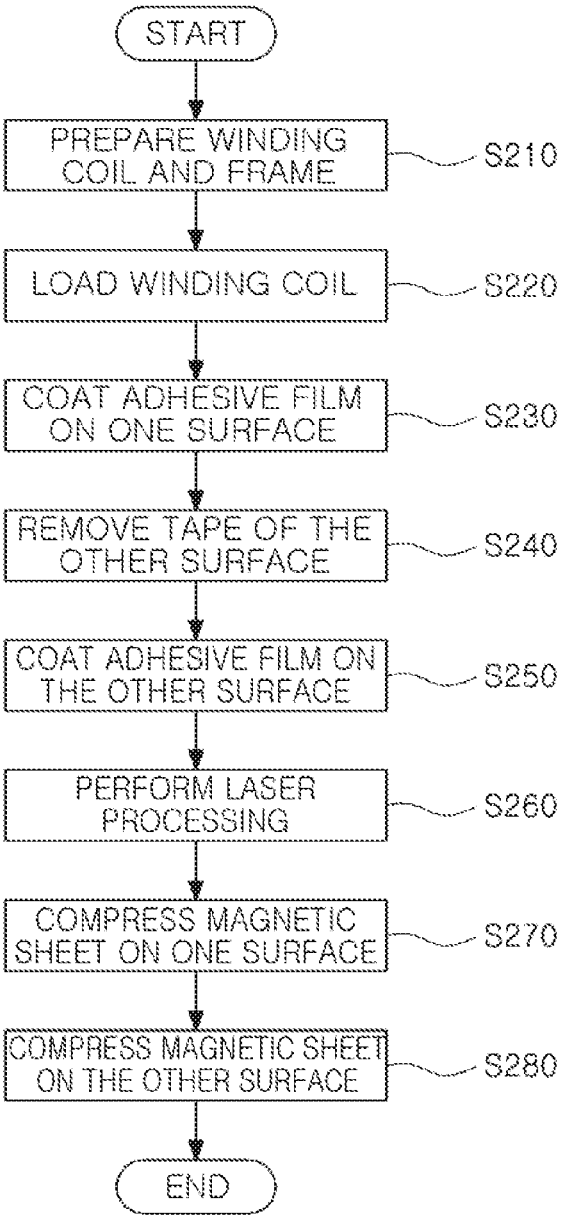
FIG. 5 is a flowchart for explaining a manufacturing method of a wire wound inductor according to another exemplary embodiment in the present disclosure.

FIG. 5 is a flowchart for explaining a manufacturing method of a wire wound inductor according to another exemplary embodiment in the present disclosure.

The manufacturing method of a wire wound inductor according to the exemplary embodiment in the present disclosure will be described below with reference to FIGS. 3 and 5.

First, the winding coils 10 and the frame 40 may be prepared (S210).

Next, each of the winding coils 10 may be loaded in a designated position in the frame 40 (S220).

Next, the insulating adhesive film 20-1 may be coated on one surface (e.g., an upper surface) of the frame 40 in which the winding coils 10 are loaded (S230). For example, the insulating adhesive film 20-1 may be positioned and then compressed on one surface of the frame 40.

Next, the tape attached on the other surface of the frame 40 may be removed (S240). As described above, according to the exemplary embodiment in the present disclosure, adhesive force between the winding coil 10 and the frame 40 is increased by the insulating adhesive film 20-1, thereby suppressing separation of the frame 40. Therefore, according to the exemplary embodiment in the present disclosure, a yield may be improved.

Next, the insulating adhesive film 20-2 may be coated on the other surface (e.g., lower surface) of the frame 40 in which the winding coils 10 are loaded (S250). For example, the insulating adhesive film 20-2 may be positioned and then compressed on the other surface of the frame 40.

Next, the insulating adhesive films 20-1 and 20-2 positioned in a central portion of the winding coil 10 may be removed through laser processing (S260). The laser processing may be performed by irradiating a laser beam on the central portion of the first and second insulating adhesive films 20-1 and 20-2 to remove the central portions of the first and second insulating adhesive films 20-1 and 20-2.

Next, at least one magnetic sheet 30-1 may be positioned and then compressed on one surface of the frame 40 on which the insulating adhesive film 20-1 is coated (S270). As described above, according to the exemplary embodiment in the present disclosure, connectivity between the winding coils 10 and the frame 40 may be sufficiently secured by the insulating adhesive films, such that misalignment of the coil when compressing the magnetic sheet 30-1 may be prevented. Therefore, according to the exemplary embodiment in the present disclosure, a yield may be improved.

Next, at least one magnetic sheet 30-2 may be positioned and then compressed on the other surface of the frame 40 on which the insulating adhesive film 20-2 is coated (S280). An individual structure including a respective magnetic core, a respective winding coil, and respective insulating adhesive films may be separated from the frame 40 and become a wire wound inductor. Accordingly, a plurality of wire wound inductors may be formed when the respective structures are separated from the frame 40.

As set forth above, the wire wound inductor and the manufacturing method thereof according to exemplary embodiments of the present disclosure, insulation between the winding coil and the magnetic core may be secured, and at the same time, coupling force therebetween may be enhanced, such that durability of the wire wound inductor may be enhanced. Further, in a process of manufacturing the wire wound inductor, connectivity between the coil and the frame may be secured, such that defects caused by misalignment of the coil may be reduced. In addition, separation of the frame from the coil may be suppressed, such that a defect that the frame is separated at the time of stacking the magnetic sheet may be reduced.

While exemplary embodiments have been shown and described above, it will be apparent to those skilled in the art that modifications and variations could be made without departing from the scope of the present invention as defined by the appended claims.

What is claimed is:

1. A wire wound inductor, comprising:

a winding coil wound around an axis extending in an axial direction;

a magnetic core embedding the winding coil; and an adhesive portion disposed between the magnetic core and the winding coil and enclosing the winding coil, wherein the adhesive portion extends from a first inner side portion of the winding coil, through a central portion of the winding coil, to a second inner side portion of the winding coil, wherein at least a portion of the adhesive portion extending through the central portion overlaps the winding coil in a direction perpendicular to the axial direction, and (1) wherein a portion of the magnetic core above and below the adhesive portion in the axial direction overlaps the winding coil in the direction perpendicular to the axial direction, or (2) a portion of the magnetic core outside the winding coil in the direction perpendicular to the axial direction overlaps the winding coil in the direction perpendicular to the axial direction.

2. The wire wound inductor of claim 1, wherein the adhesive portion is disposed on a surface of the winding coil and at an outer side portion of the winding coil, and the magnetic core is disposed on and beneath the adhesive portion formed at the outer side portion of the winding coil.

3. The wire wound inductor of claim 2, wherein the magnetic core is disposed on and beneath an extending portion of the adhesive portion in the central portion of the winding coil.

4. The wire wound inductor of claim 1, wherein the adhesive portion is made of an Ajinomoto Build-up Film (ABF).

5. The wire wound inductor of claim 1, wherein the winding coil includes a conductive wire wound at least one turn.

6. The wire wound inductor of claim 1, wherein at least a portion of each of both ends of the winding coil is exposed to the outside of the magnetic core.

* * * * *